US005842276A

United States Patent [19]

Asher et al.

[11] Patent Number: 5,842,276

[45] Date of Patent: Dec. 1, 1998

[54] SYNTHETIC PANEL AND METHOD

[75] Inventors: William V. Asher, Baxter Springs, Kans.; Kenneth P. Lanahan, Springfield; Curtis T. Martin, Republic, both of Mo.

[73] Assignee: QB Technologies, L.C., Ava, Mo.

[21] Appl. No.: 556,265

[22] Filed: Nov. 13, 1995

[51] Int. Cl.[6] ..... B23P 15/00

[52] U.S. Cl. ..... 29/897.32; 52/309.16; 52/220.2; 52/592.1; 264/142; 264/158; 83/171; 83/16; 83/39

[58] Field of Search ..... 29/897.3, 897.32, 29/897.34, 897.1, 402.11, 402.12; 52/309.16, 220.2, 220.3, 592.3, 592.1; 264/142, 158; 83/171, 16, 39, 56

[56] References Cited

U.S. PATENT DOCUMENTS

| | | | |
|---|---|---|---|
| 3,487,598 | 1/1970 | Lopina | 52/220.2 |
| 3,928,691 | 12/1975 | Knudson | 52/309.16 |
| 4,037,377 | 7/1977 | Howell et al. | 52/592.1 |
| 4,154,030 | 5/1979 | Huguet | 52/98 |
| 4,163,349 | 8/1979 | Smith | 52/241 |
| 4,224,774 | 9/1980 | Petersen | 52/404 |
| 4,284,447 | 8/1981 | Dickens et al. | 156/78 |
| 4,330,921 | 5/1982 | White, Jr. | 29/897.32 |
| 4,341,831 | 7/1982 | Kleiss | 52/309.16 |
| 4,363,684 | 12/1982 | Hay, II | 156/201 |
| 4,602,466 | 7/1986 | Larson | 52/309.11 |
| 4,608,893 | 9/1986 | Mühne | 83/171 |
| 4,641,468 | 2/1987 | Slater | 52/309.4 |
| 4,683,792 | 8/1987 | Demont | 83/16 |
| 4,754,678 | 7/1988 | Nichols et al. | 83/16 |
| 4,774,794 | 10/1988 | Grieb | 52/309.7 |
| 4,813,193 | 3/1989 | Altizer | 52/210 |
| 4,856,244 | 8/1989 | Clapp | 52/309.7 |
| 4,862,660 | 9/1989 | Raymond | 52/221 |
| 4,981,003 | 1/1991 | McCarthy | 52/309.16 |
| 5,021,108 | 6/1991 | Bergqvist | 156/79 |
| 5,067,296 | 11/1991 | Brown et al. | 52/309.7 |
| 5,072,569 | 12/1991 | VanTassel | 52/745 |
| 5,245,809 | 9/1993 | Harrington | 52/309.11 |
| 5,265,389 | 11/1993 | Mazzone et al. | 52/309.7 |
| 5,269,109 | 12/1993 | Gulur | 52/309.9 |
| 5,279,089 | 1/1994 | Gulur | 52/309.11 |
| 5,285,607 | 2/1994 | Sommerville | 52/235 |
| 5,353,560 | 10/1994 | Heydon | 52/281 |
| 5,381,638 | 1/1995 | Andersson | 52/592.1 |
| 5,465,541 | 11/1995 | Lin et al. | 52/220.2 |
| 5,497,589 | 3/1996 | Porter | 52/592.1 |
| 5,497,595 | 3/1996 | Kalinin | 52/309.16 |
| 5,519,971 | 5/1996 | Ramirez | 52/220.2 |
| 5,660,907 | 8/1997 | Skalka | 52/309.7 |

OTHER PUBLICATIONS

Aug. 1990 Publication from *Building Systems Builder* (Franklin PA) and entitled "Great Walls".

*Primary Examiner*—Larry I. Schwartz
*Assistant Examiner*—Marc W. Butler
*Attorney, Agent, or Firm*—Townsend and Townsend and Crew LLP

[57] ABSTRACT

A method for producing a polymeric foamed material panel including the steps of providing a polymeric foamed material; and cutting (e.g. hot wire cutting) the polymeric foamed material until reaching a preconfiguration cut point. The method further includes cutting subsequently from the preconfiguration cut point a brace-receiving configuration in the polymeric foamed material; and sliding a brace member into the brace-receiving configuration to produce a polymeric foamed material panel.

80 Claims, 12 Drawing Sheets

SYNTHETIC PANEL AND METHOD

BACKGROUND OF THE INVENTION

1. Field of the Invention

This invention relates to a synthetic panel. More specifically, this invention provides a polymeric foamed panel (e.g. a low density synthetic panel) and method for producing the polymeric foamed panel. This invention further provides a method for forming a structure with two or more polymeric foamed panels.

2. Description of the Prior Art

A patentability investigation was conducted and the following U.S. Patents were discovered:

U.S. Pat. No. 4,163,349 to Smith; U.S. Pat. No. 4,284,447 to Dickens et al; U.S. Pat. No. 4,602,466 to Larson; U.S. Pat. No. 4,774,794 to Grieb; U.S. Pat. No. 4,813,193 to Altizer; U.S. Pat. No. 4,856,244 to Clapp; U.S. Pat. No. 4,862,660 to Raymond; U.S. Pat. No. 4,981,003 to McCarthy; U.S. Pat. No. 5,021,108 to Bergqvist; U.S. Pat. No. 5,245,809 to Harrington; U.S. Pat. No. 5,265,389 to Mazzone et al; U.S. Pat. No. 5,269,109 to Gulur; and U.S. Pat. No. 5,279,089 to Gulur.

U.S. Pat. No. 4,163,349 to Smith teaches an insulated building panel having a core and overlapping skins which include an interior skin and an exterior skin. The interior skin at the panel's bottom covers a panel foot plate and the exterior skin at the panel's bottom also covers the panel foot plate and extends beyond to form an erection stop. End panels have relieved core areas for receiving bearing members associated with a wall splice bearing post, and double parallel spaced header beams have an offset splice area within a several panel wall section.

U.S. Pat. No. 4,284,447 to Dickens et al teaches a method of forming a panel structure useful in building construction and the like including the steps of heating a heat expandable plastic in a separable mold having a cavity with the configuration of the resultant panel to form a panel core and adhering thin reinforcing strips to the front and back surfaces of the core. Control over the dimensions and configuration of the panel to Dickens et al is obtained by adhering the strips to the core in the mold while applying heat thereto whereby core shrinkage is minimized.

U.S. Pat. No. 4,602,466 to Larson teaches a method and apparatus for making building panels, including a means for positioning upper and lower rigid sheets of material, such as paper pulp, in spaced relation so that foamable material disposed between the sheets can move into gripping engagement with both sheets as it expands and solidifies.

U.S. Pat. No. 4,774,794 to Grieb teaches a foam-cement building having the walls, roof and/or floor formed from a plurality of self supporting foam building blocks of varying density with a strong thin continuous structural and architectural coating on the surface of the blocks. The coating is formed from cement, reinforced with a fiberglass mesh and fiberglass roving strands. The blocks are interconnected by a mechanical key system or splines to form a monolithic structure.

U.S. Pat. No. 4,813,193 to Altizer teaches an improved modular building comprising sidewall modules and ceiling modules. The sidewall modules comprise a primary frame to which a secondary frame of furring strips is attached. The sidewall modules further comprise foam insulation molded around the primary and secondary frame to define exterior and interior planar surfaces. The ceiling modules include frame means supporting a plurality of ceiling joists, and foam insulation dispersed within the frame means and between the ceiling joist so as to define upper and lower ceiling surfaces.

U.S. Pat. No. 4,856,244 to Clapp teaches tilt-wall concrete panels adapted for constructing small buildings with "finished" interiors, especially single-family residences, etc. A peripheral frame of wooden members is laid on top of a barrier film of plastic (e.g. 4 mil polyethylene) on a horizontal surface. Wood-like studs are then placed within the frame and nailed thereto. Any desired utility cables and service pipes are positioned within the frame. Clapp further teaches that an insulating foam cover, preferably high-density polyurethane, is then generated within and over the frame, to a depth that at least covers the wood-like studs and any utility or service lines. Foam having a thickness of about 1.5 inches covers these elements and bonds them securely together as a stable, easily movable "plate"—after the foam plastic has hardened. A plurality of such plates, each sized to form a part of a building's wall, are positioned at a construction site where a foundation has been prepared. Clapp discloses that a concrete form is then temporarily completed around each plate, and concrete is poured on top thereof, to an average depth of about 4 to 6 inches. After the concrete hardens, the temporary form is removed and the composite panel is tilted to a vertical position. A plurality of such panels by Clapp are positioned edge-to-edge and joined to form a continuous outer wall for the building. The plastic barrier film is removed from the face of each panel, and interior wallboards or the like may be nailed to the exposed wood-like studs.

U.S. Pat. No. 4,862,660 to Raymond teaches an integral energy efficient load-bearing exterior wall fabricated of lightweight foam surrounding plastic load-bearing columns. Raymond discloses pre-fabricated modular wall panels as individual building elements and as part of an integrated building system. The prefabricated modular wall panels are made from a foamed material that is molded around a plurality of vertically disposed hollow support columns. Each of the columns in U.S. Pat. No. 4,862,660 to Raymond is taught as containing a pair of opposed and vertically disposed T-shaped fastening supports which are arranged to form part of the interior and exterior surfaces of the foamed wall. The hollow columns are set onto locking base plates which are mounted on a wood or concrete deck system. Locking top plates are also mounted on wood and are then placed on top of the columns. The tubular columns are made of a plastic material and are shaped in cross-section in the form of a rectangle, square, diamond, oval or circle.

U.S. Pat. No. 4,981,003 to McCarthy teaches a wall panel constructed from expanded polystyrene beads in an expanded polystyrene mold with structural members embedded in it during the molding process. The structural members are in the form of two by four studs placed at sixteen inch centers. Adjacent panels have interlocking grooves and ridges which fit together. McCarthy teaches that an advantage of his invention is that a total insulated wall is created with no cracks or spaces in the insulation.

U.S. Pat. No. 5,021,108 to Bergqvist teaches an apparatus for manufacture of laminated panels having a foamed plastic core material including an inclined press having a fixed platen surface and a movable platen surface hinged adjacent to its lower edge. Panel thickness is adjustable by a mechanism which moves the hinge pivot relative to fixed platen surfaces. The platen surfaces in U.S. Pat. No. 5,021,108 to Bergqvist are clamped at their upper edges by spaced clamps operable by lever and crank assemblies. A retractable seal spacer has liquid plastic injection nozzles and gas venting tubes in fluid communication with a hollow cavity in the press.

U.S. Pat. No. 5,245,809 to Harrington teaches a panel for providing walls, roofs and floors with thermal insulation and fire retardance. The panel is taught to comprise at least two essentially parallel face members separated to form a space between the face members and urethane within the space to provide the thermal insulation and fire retardance. The panel may additionally include frame members extending between the face members for providing support and for enclosing the urethane. At least one of the frame members has at least one port through which urethane foam can enter between the face members. U.S. Pat. No. 5,245,809 to Harrington further teaches a method for creating a panel for providing insulated and fire retardant walls, floors and roofs. The method is taught by Harrington to include the steps of joining frame members together to form a panel frame of the desire dimensions, attaching face members to either side of the panel frame so that at least one enclosed space is formed within the face members and frame members, creating at least one port leading into the at least one enclosed space, and injecting urethane foam through the at least one port into the at least one enclosed space.

U.S. Pat. No. 5,265,389 to Mazzone et al teaches a composite building panel including a core of a foamed polymeric insulating material, such as expanded polystyrene, having a plurality of uniformly spaced open box tubes retained in vertical grooves formed in the rear surface of the core by a two-part epoxy adhesive. The tubes are mechanically connected at their ends to one leg of continuous horizontal channels having their other leg adhesively secured to the core at horizontal slots. The front surface of the core is continuous without seams and may be coated with a variety of exterior insulation finishing system coatings.

U.S. Pat. Nos. 5,269,109 and 5,279,089 to Gulur teach an insulated load bearing wall comprising panels of extruded polymer foam into which tubular, load carrying frame members have been incorporated. A tongue is formed at one vertical edge of each panel and a groove is formed at the opposite vertical edge. The tubular frame members are bonded to the extruded polymer foam.

None of the foregoing U.S. Patents teach the particular methods of the present inventions for producing panels having a core of a foamed polymeric material, such as expanded polystyrene. StressSkin and Structural Panels have been in use for several decades. Alden Dow constructed his first StressSkin panel house in the late forties. Both technologies have relied on an inner and outer skin of wood either being plywood or more recently OSB (oriented strand board). The plywood or OSB skin is attached to the foam core with an adhesive and then pressed together. The laminated panels are thereafter processed into engineered parts. The plywood or OSB skin do not provide for both a structure and a substrate for the interior and exterior finishes. Thus, what is needed and what has been invented by us is a foamed wall system and method that provides for a foamed polymeric material that becomes both a structure and a substrate for the interior and exterior finishes.

SUMMARY OF THE INVENTION

The present invention accomplishes its desired objects by providing a method for producing a polymeric foamed material panel (e.g. a low density synthetic panel) comprising the steps of:

(a) providing a polymeric foamed material having a defined planer surface and a pair of opposed ends;

(b) cutting the polymeric foamed material of step (a) in a generally perpendicular direction from the defined planer surface until reaching a preconfiguration cut point;

(c) cutting subsequently from the preconfiguration cut point a brace-receiving configuration in the polymeric foamed material such that the brace-receiving configuration terminates in the opposed ends; and (d) sliding a brace member into the brace-receiving configuration to produce a polymeric foamed material panel.

The cutting in step (b) and the cutting in step (c) comprises cutting the polymeric foamed material of step (a) with a hot wire cutter which is preferably operated by a computer. The brace-receiving configuration in the polymeric foamed material comprises a slot for receiving the brace member. The slot includes a seared wall for facilitating the sliding of the brace member. The brace member includes an opening with an opening perimeter. The method additionally comprises forming a polymeric foamed material opening in the polymeric foamed material. The polymeric foamed material opening has a polymeric foamed material opening perimeter. The sliding in step (d) comprises sliding the brace member into the brace-receiving configuration until the opening of the brace member is generally aligned with the polymeric foamed material opening. The opening perimeter of the opening in the brace member has a dimension that is greater than a dimension of the polymeric foamed material opening perimeter of the polymeric foamed material opening in the polymeric foamed material.

The method preferably additionally comprises passing a conduit through the polymeric foamed material opening of the polymeric foamed material and through the opening of the brace member; preferably such that the conduit is essentially supported by the polymeric foamed material and essentially does not contact any of the opening perimeter of the opening in the brace member. The cutting in step (b) further comprises cutting a generally straight thread-like slot from a defined surface of the polymeric foamed material to the preconfiguration cut point. The brace-receiving configuration is essentially a generally C-shaped slot. The method further preferably includes that the cutting in step (b) and the cutting in step (c) is with a hot wire cutter wherein the hot wire cutter is at a temperature (e.g. 230° F. to 580° F.) such as to sear at least one wall of the C-shaped slot to smooth and harden the wall of the C-shaped slot for facilitating the sliding in step (d) of the brace member. The polymeric foamed material may be any suitable material (i.e. either low density and/or high density including engineered resins) that is capable of producing the panel or structure of the present invention, such as expanded polystyrene (EPS).

The present invention further accomplishes its desired objects by providing a method for forming a structure comprising the steps of:

(a) providing a first polymeric foamed material having a first defined edge, a first defined planer surface, and a pair of opposed first ends;

(b) cutting the first polymeric foamed material in a generally perpendicular direction from the first defined planar surface until reaching a first preconfiguration cut point and cutting subsequently from the first preconfiguration cut point a first brace-receiving-configured slot in the first polymeric foamed material such that the first brace receiving configured slot terminates in the opposed first ends;

(c) cutting the first defined edge of the first polymeric foamed material to form a tongue on the first defined edge;

(d) sliding a first brace member into the first brace-receiving-configured slot;

(e) providing a second polymeric foamed material having a second defined edge, a second defined planar surface, and a pair of opposed second ends;

(f) cutting the second polymeric foamed material in a generally perpendicular direction from the second defined planar surface until reaching a second preconfiguration cut point and cutting subsequently from the second preconfiguration cut point a second brace-receiving-configured slot in the second polymeric foamed material such that the second brace-receiving-configured slot terminates in the opposed second ends;

(g) cutting the second defined edge of the second polymeric foamed material to form a channel in the second defined edge;

(h) sliding a second brace member into the second brace-receiving-configured slot; and (i) sliding the tongue on the first defined edge of the first polymeric foamed material into the channel in the second defined edge of the second polymeric foamed material to form a structure.

The cutting in steps (b), (c), (f) and (g) comprises cutting with a hot wire cutter; preferably a computer operated hot wire cutter. The first brace-receiving-configured slot in the first polymeric foamed material and the second brace-receiving-configured slot in the second polymeric foamed material respectively comprises a first slot with a first wall for receiving the first brace member and a second slot with a second wall for receiving the second brace member. The first wall of the first slot includes a first seared wall for facilitating the sliding of the first brace member and the second wall of the second slot includes a second seared wall for facilitating the sliding of the second brace member. The first brace member includes a first opening with a first opening perimeter and the second brace member includes a second opening with a second opening perimeter.

The method additionally includes forming a first polymeric foamed material opening in the first polymeric foamed material and forming a second polymeric foamed material opening in the second polymeric foamed material. The first polymeric foamed material opening includes a first polymeric foamed material opening perimeter and the second polymeric foamed material opening includes a second polymeric foamed material opening perimeter. The sliding step (d) comprises sliding the first brace member into the first brace-receiving-configured slot until the first opening of the first brace member is generally aligned with the first polymeric foamed material opening; and the sliding step (h) comprises sliding the second brace member into the second brace-receiving-configured slot until the second opening of the second brace member is generally aligned with the second polymeric foamed material opening. The first and second openings of the first and second brace members and the first and second polymeric foamed material openings of the first and second polymeric foamed materials are all aligned for receiving a conduit. The first opening perimeter of the first opening in the first brace member has a first dimension that is greater than a first dimension of the first polymeric foamed material opening perimeter of the first polymeric foamed material opening in the first polymeric foamed material; and the second opening perimeter of the second opening in the second brace member has a second dimension that is greater than a second dimension of the second polymeric foamed material opening perimeter of the second polymeric foamed material opening in the second polymeric foamed material.

The method preferably additionally comprises passing a conduit through the first polymeric foamed material opening in the first polymeric foamed material and through the first opening of the first brace member and further passing the conduit through the second polymeric foamed material opening in the second polymeric material and through the second opening of the second brace member; preferably such that the conduit is essentially supported by the first polymeric foamed material and by the second polymeric material and essentially does not contact any of the first opening perimeter of the first opening in the first brace member and any of the second opening perimeter of the second opening in the second brace member.

The method also preferably additionally comprises cutting, prior to the cutting in step (b), a first generally straight thread-like slot in the first polymeric foamed material up to a first preconfiguration cut point wherein the step (b) cutting commences; and further also preferably additionally comprises cutting, prior to the cutting in step (f), a second generally straight thread-like slot in the second polymeric foamed material up to a second preconfiguration cut point wherein the step (f) cutting commences. The first brace-receiving-configured slot is essentially a first generally C-shaped slot and the second brace-receiving-configured slot is essentially a second generally C-shaped slot. The cutting in step (b), step (c), step (f), and step (g) comprises cutting with a hot wire cutter which is at a temperature (e.g. 230° F. to 580° F.) such as to sear at least one wall of the first C-shaped slot and to sear at least one wall of the second C-shaped slot to smooth and harden the wall of the first C-shaped slot and to smooth and harden the wall of the second C-shaped slot for facilitating the sliding in step (d) of the first brace member and for facilitating the sliding in step (h) of the second brace member. The first polymeric foamed material and the second polymeric foamed material both may consist of any suitable material (e.g. any suitable polymeric foamed material) such as that comprising expanded polystyrene (EPS).

The present invention provides a method for producing a polymeric foamed material panel comprising the steps of:

(a) providing a polymeric foamed material with a plan side surface in a generally stationary position, said polymeric foamed material having a defined planar surface and a pair of opposed ends;

(b) cutting the generally stationary polymeric foamed material of step (a) in a generally perpendicular direction from the defined planar surface until reaching a preconfiguration cut point;

(c) cutting subsequently from the preconfiguration cut point a brace-receiving configuration in the generally stationary polymeric foamed material such that the brace-receiving configuration terminates in the opposed ends; and (d) sliding a brace member into the brace-receiving configuration to produce a polymeric foamed material panel.

The present invention further provides a method for producing a polymeric foamed material panel comprising the steps of:

(a) providing a polymeric foamed material;

(b) providing a brace member with brace sides;

(c) cutting a brace-receiving configuration in the polymeric foamed material; and (d) sliding the brace member of step (b) into the brace-receiving configuration such that the brace sides are essentially surrounded by the polymeric foamed material to produce a polymeric foamed material panel.

The present invention also further provides a method for producing a polymeric foamed material panel comprising the steps of:

(a) providing a polymeric foamed material with a defined planar side surface and a pair of opposed ends;

(b) cutting with a cutter in a generally perpendicular direction from the defined planar side surface a path in the polymeric foamed material of step (a) such that the path terminates in the opposed ends;

(c) retracing the path of step (b) with the cutter to produce a brace-receiving configuration in the polymeric foamed material such that the brace-receiving configuration terminates in the opposed ends; and (d) sliding a brace member into the brace-receiving configuration to produce a polymeric foamed material panel.

The present invention yet also further provides a method for producing a polymeric foamed material panel comprising the steps of:

(a) providing a polymeric foamed material having a defined planar side surface and a pair of opposed ends;

(b) contacting the defined planar side surface with a cutter;

(c) cutting with the cutter polymeric foamed material in a generally perpendicular direction from the defined planar surface thereof until reaching a preconfiguration cut point within the polymeric foamed material;

(d) cutting with the cutter from the cutting preconfiguration cut point of step (c) a slot in the polymeric foamed material of step (c) such that the slot terminates in the opposed ends;

(e) cleaning the slot of step (d) with the cutter to produce a brace-receiving configuration in the polymeric foamed material such that the brace-receiving configuration terminates in the opposed ends; and (f) sliding a brace member into the brace-receiving configuration to produce a polymeric foamed material panel.

The present invention also further accomplishes its desired objects by providing a polymeric foamed material panel comprising a panel consisting of a polymeric foamed material; a brace-receiving-configured slot disposed in the polymeric foamed material of the panel and a brace member disposed in the brace-receiving-configured slot in the polymeric foamed material of the panel. The brace-receiving-configured slot includes at least one seared wall; and the polymeric foamed material panel additionally comprises a generally straight thread-like slot extending from a defined surface of the polymeric foamed material to the brace-receiving-configured slot; and a second generally straight thread-like slot extending from the defined surface of the polymeric foamed material to a generally cylindrical opening in the polymeric foamed material. The brace member has a brace opening which is generally aligned with the cylindrical opening in polymeric foamed material.

It is therefore an object of the present invention to provide a method for producing a polymeric foamed material panel.

It is another object of the present invention to provide a method for forming a structure.

It is yet further an object of the present invention to provide a polymeric foamed material panel.

These, together with the various ancillary objects and features which will become apparent to those skilled in the art as the following description proceeds, are attained by this novel method and polymeric foamed material panel, a preferred embodiment being shown with reference to the accompanying drawings, by way of example only, wherein:

BRIEF DESCRIPTION OF THE DRAWINGS

FIG. 4 is a partial perspective view of two panel members disposed contiguous to each other and encapsulated in sheetrock or the like;

FIG. 5 is a top plan view of the pair of contiguous panel members of FIG. 4 encapsulated in sheetrock or the like;

DETAILED DESCRIPTION OF THE INVENTION

Figure 1:
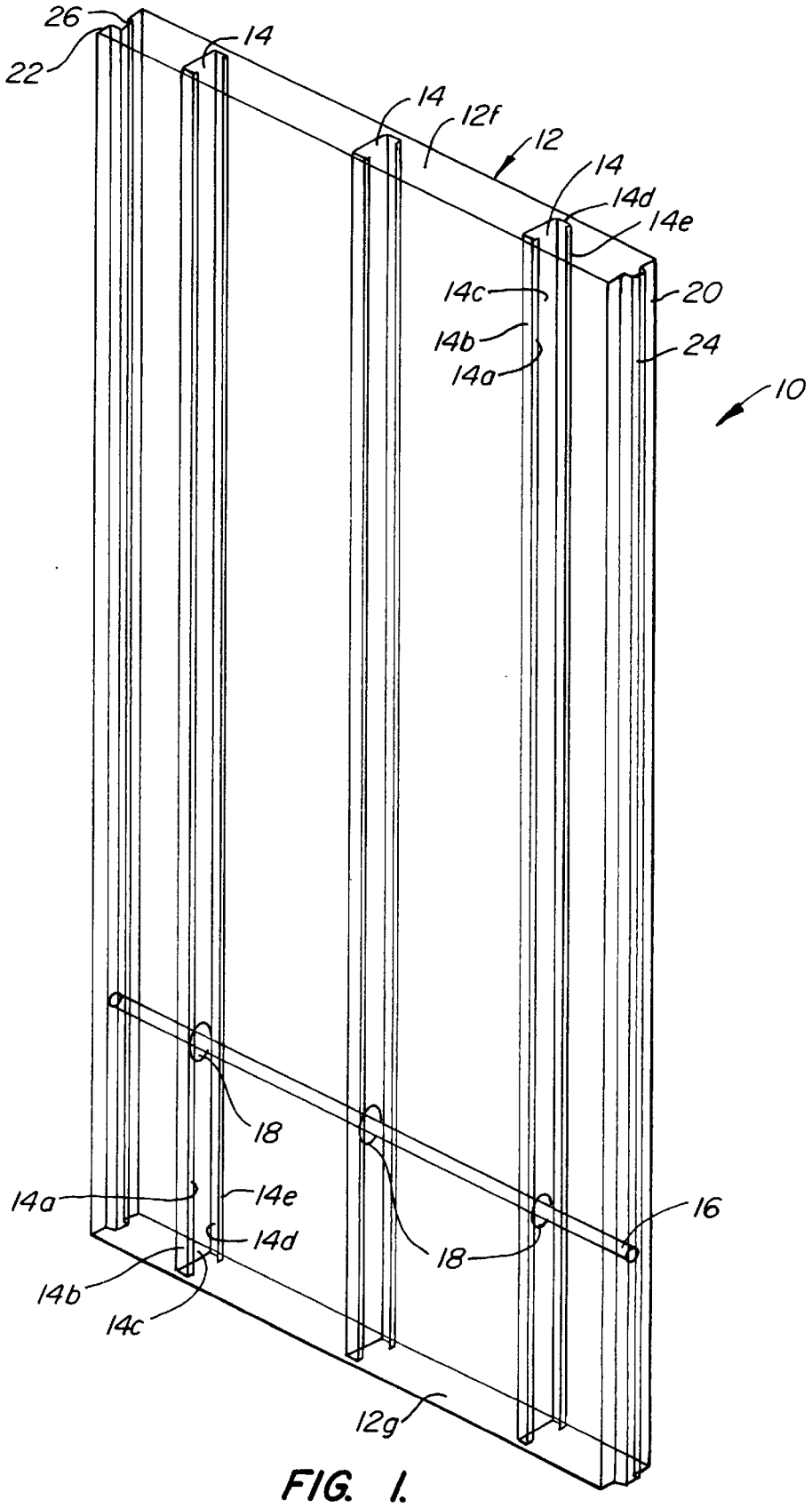
FIG. 1 is a perspective view of a polymeric foamed material panel produced in accordance with the method of the present invention.
Figure 6:
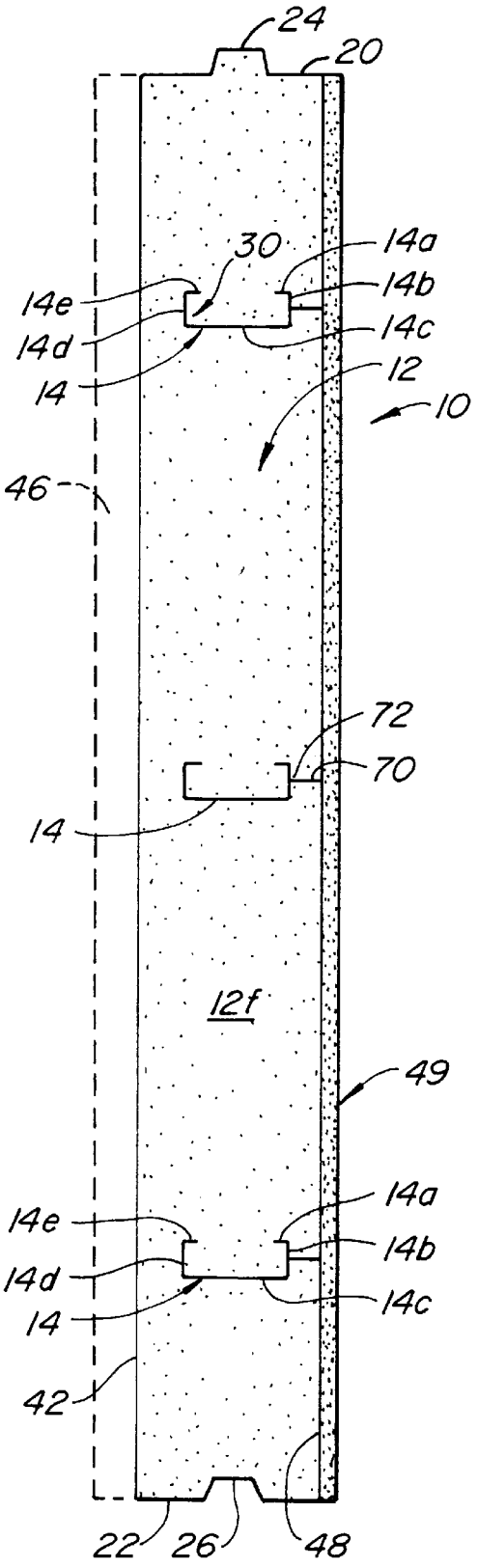
FIG. 6 is a top plan view of a panel member having a plurality of steel studs or brace members disposed therein with the inside wall thereof covered with sheetrock and further having a tongue member at one end and a channel member at another end.
Figure 8:
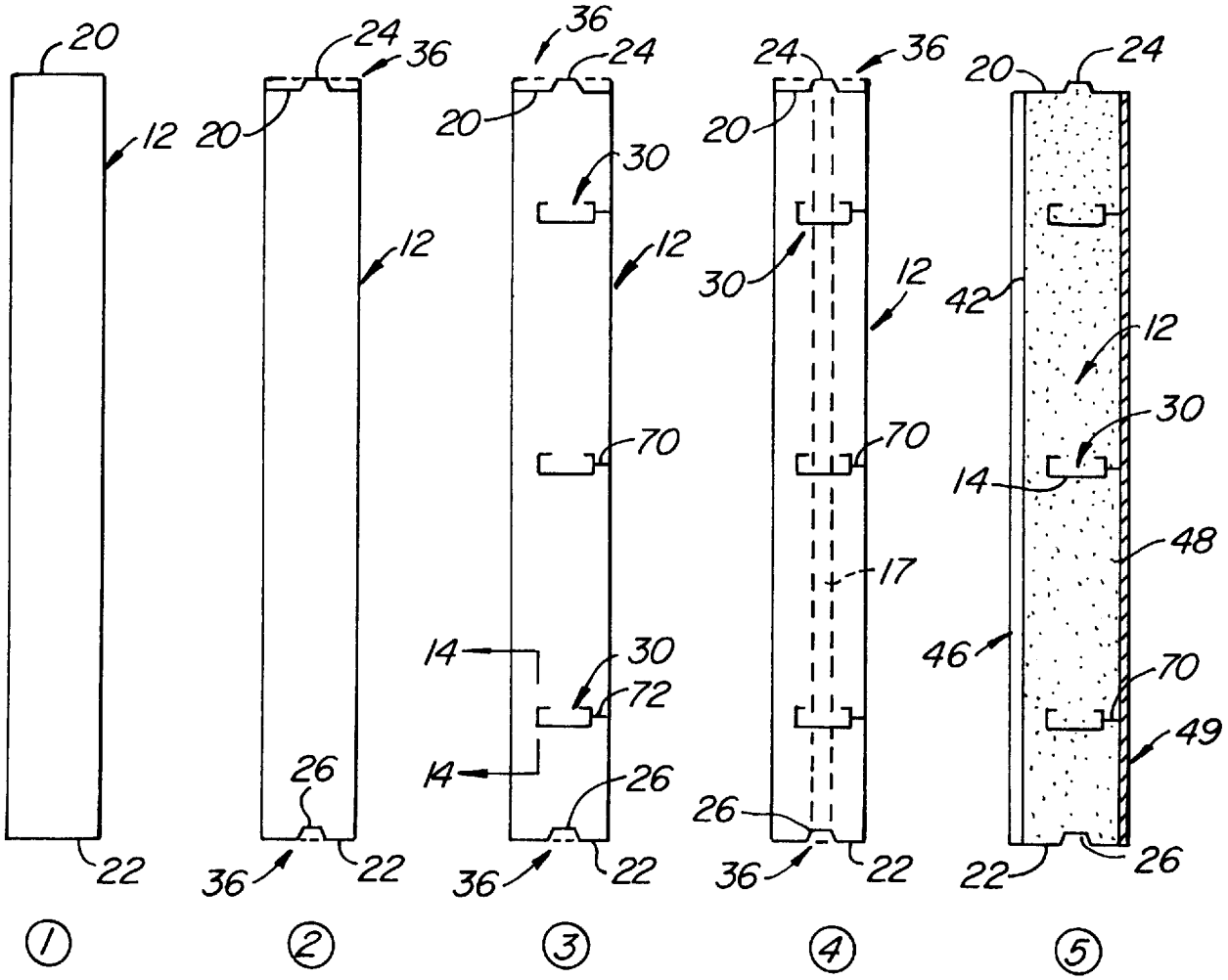
FIG. 8 is a schematic diagram of the various process steps in producing the panel member of the present invention.
Figure 14:
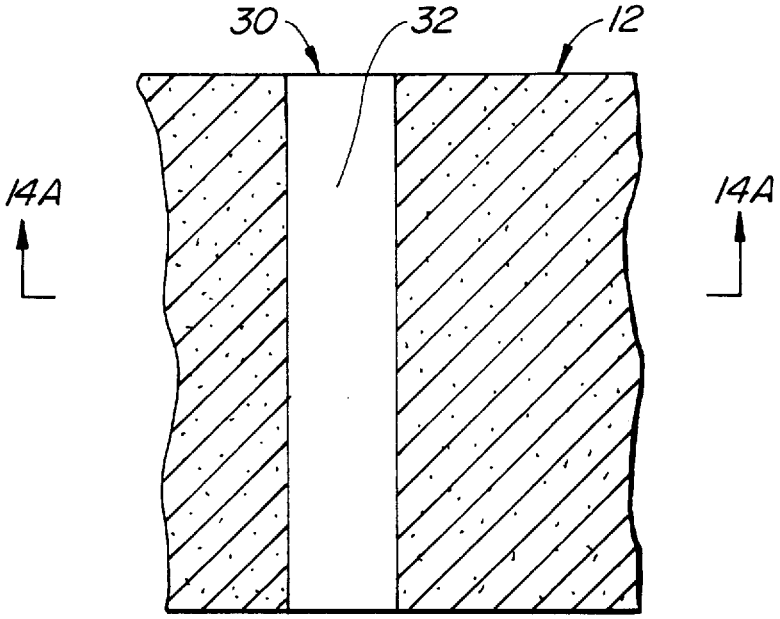
FIG. 14 is a partial vertical sectional view taken in direction of the arrows and along the plane of line 14—14 in FIG. 8.
Figure 14A:
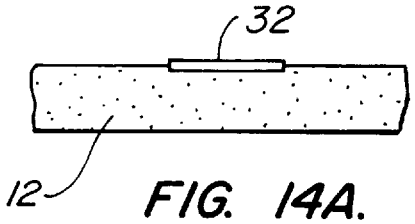
FIG. 14A is a vertical sectional view taken in direction of the arrows and along the plane of line 14A—14A in FIG. 14.

Referring in detail now to the drawings wherein similar parts of the invention are identified by like reference numerals, there is seen a panel member, generally illustrated as 10, produced in accordance with the method of the present invention. The panel member 10 comprises a polymeric foamed material, generally illustrated as 12, and a plurality of brace members 14 disposed in the polymeric foamed material 12. The polymeric foamed material 12 has a pair of opposed ends 12*f* and 12*g* (see FIGS. 1, 6, 9 and 10). Each of the brace members 14 pass into a slot, generally illustrated as 30 (see FIGS. 8 and 14), which was preferably preformed or precut. As best shown in FIG. 6, slot 30 may be non-linear. Each of the brace members 14 may be any suitable brace member such as studs, load-bearing members, etc. constructed of any suitable material (e.g. metal, wood, etc.) Most preferably, the brace members 14 are steel studs for load-bearing and adding strength to the polymeric foamed material 12. As best shown in FIGS. 1 and 6, each brace member 14 includes brace slides 14*a*, 14*b*, 14*c*, 14*d* and 14*e* which are all essentially surrounded by the polymeric foamed material 14.

The panel member 10 may additionally include a conduit 16 also disposed in the polymeric foamed material 12, preferably transversely disposed therein and generally normal with respect to the brace members 14. The conduit 16 passes into a polymeric opening 17 (see FIGS. 10 and 11) in the polymeric foamed material 12. The conduit(s) 16 may be employed for any suitable use; for example, a utility receptor (e.g. electrical wires), water, gas, etc. The polymeric opening 17 as well as slot 30 are preferably formed with at least one seared or cartherized wall 32. Cartherizing and/or searing the wall(s) of the polymeric opening 17 and/or slot 30 hardens and smooths the wall(s) to facilitate the sliding of the brace member(s) 14 thereinto. As will be further explained below, the seared or cartherized wall 32 is preferably formed by hot wire cutting.

Each of the brace members 14 has an opening 18 that has a circumference (or perimeter) which is larger than the circumference (or perimeter) of the conduit 16 and larger than the circumference (or perimeter) of the polymeric opening 17 such that after any and all opening(s) 18 has been aligned with any and all polymeric opening(s) 17, the conduit 16 may pass through the polymeric opening(s) 17 and through the opening 18 in the brace members 14, preferably without contacting any of the circumferential perimeter of the opening 18 and be supported in a suspended relationship with respect thereto by the polymeric foamed material 12. When ever "perimeter" is stated in the specification and in the claims, it is to be understood to mean any boundary of any opening (e.g. a square opening, a circular opening, etc.). Thus, the term "perimeter" is to include circumference.

Figure 13:
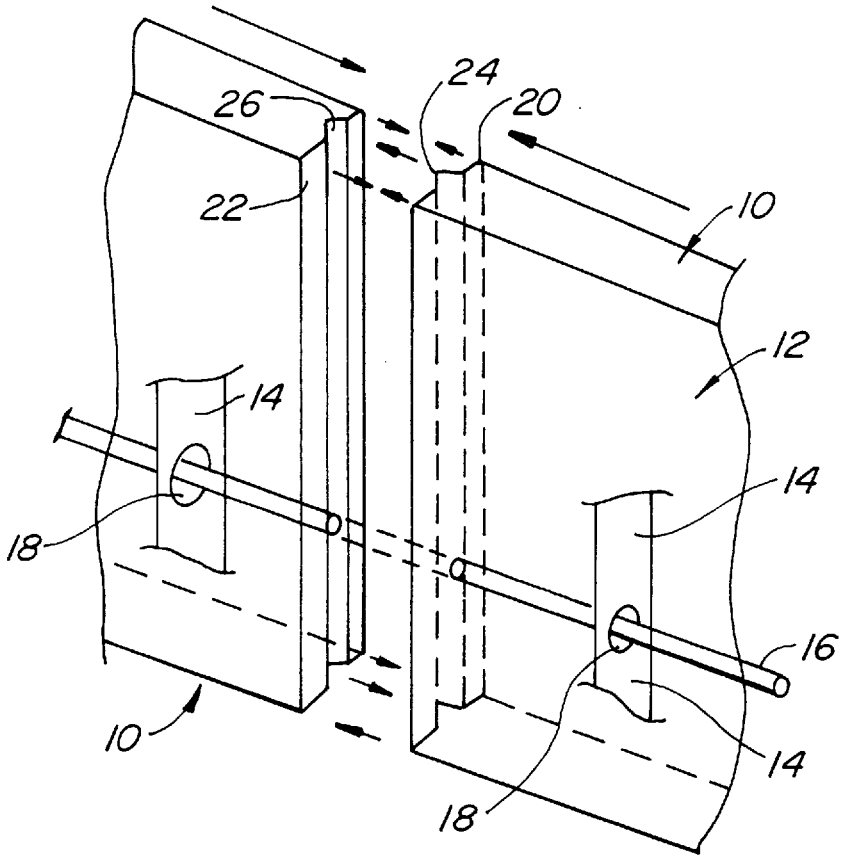
FIG. 13 is a partial perspective view of two polymeric foamed material panel members with ends of the two polymeric foamed material panel members being generally aligned such that the tongue on one end of one panel member may slid into a channel in one of the ends of the other panel member.
Figure 12:
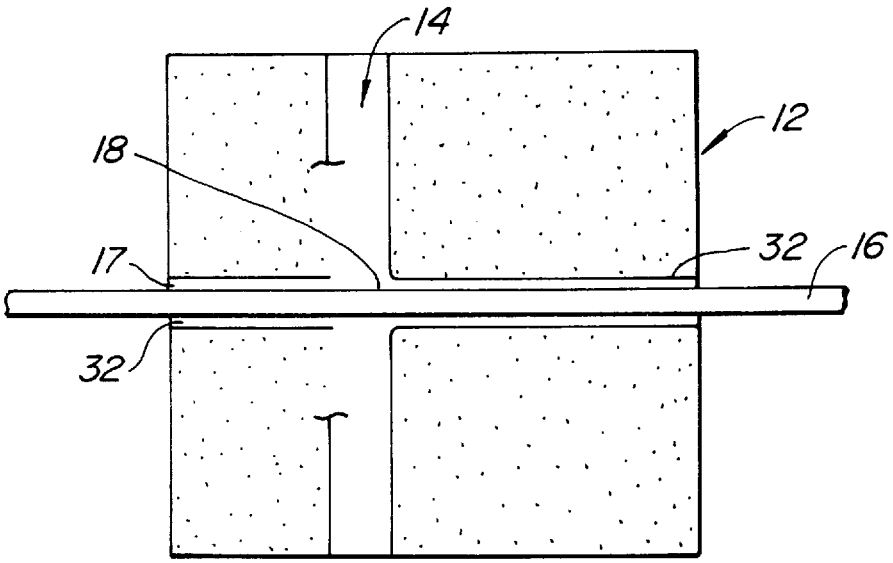
FIG. 12 is vertical sectional view of the polymeric foam material supporting a conduit while the conduit passes through an opening in the brace or stud member without touching any of the circumference or perimeter of the stud or brace member.

Each of the panel members 10 also preferably includes ends 20 and 22 (each a defined edge). End 20 is formed with a tongue 24 and the end 22 is formed with a channel 26. Formation of the tongue 24 and/or the channel 26 is preferably accomplished by cutting (preferably hot wire cutting) a portion 36 (see FIG. 8) of polymeric foamed material 12 off of the end 20 and/or end 22 respectively. As best shown in FIG. 13, a pair of panel members 10—10 may be interengaged by sliding the tongue 24 of end 20 into the channel 26 of end 22 to form a structure. As further best shown in FIG. 13, each of the panel members 10 includes the brace member 14 having the opening 18 with the conduit 16 passing through and between the two interengaged panel members 10—10 such that the polymeric foamed material 12 of each of the panel members 10 supports the conduit 16 in a space relationship with respect to the perimeter (i.e. circumference) of each of the openings 18. In other words, the conduit 16 is preferably not to contact any part of the brace member 14.

The polymeric foamed material 12 of the present invention may be any suitable material that is capable of producing the panel 10 of the present invention, preferably a suitable material that is capable of being cut and/or burned and/or melted (i.e. hot wire cut or melted) to produce the panel 10 of the present invention. The polymeric foamed material 12 may be either high density and/or low density polymeric material. The polymeric foamed material 12 provides significant insulating qualities and thereby reduces heat and cooling costs as compared with conventional fiberglass batt insulation of equal thickness. Furthermore, the polymeric foamed material 12 in combination with the plurality of brace members 14 may be customed specified to provide complete design flexibility and superior structural advantages in shear strength and lateral load capability. The polymeric foamed material 12 exhibits a high strength to weight ratio and also exhibits super insulating properties. The polymeric foamed material panel 10 provides both a structure and a substrate for the interior and exterior finishes.

Suitable polymeric foamed materials 12 have been discovered to be heat expandable plastic materials, such as pelletized polystyrene and the like. Other suitable heat expandable plastic materials that are within the spirit and scope of the present invention for the polymeric foamed material 12 is polyethylene, polyurethane, polypropylene, polyvinylchloride, etc., all being at a density to provide good thermal insulation and strength. The density is preferably of the order of about ½ pound per cubic foot to about 8 pounds per cubic foot. A density of from about 1 pound per cubic foot to about 3 pounds per cubic foot has been found to provide very good thermal properties as well as excellent physical properties including strength.

The heat expandable plastic material also provides for excellent burn-back or melt-back qualities when cut by a hot wire cutter (identified as "50" below). When the below identified hot wire cutter cuts the heat expandable plastic material, the material typically burns and melts, more specifically melts back, to form the polymeric opening 17 or slot 30 within the polymeric foamed material 12. Prior to commencing the formation of polymeric opening 17 and/or slot 30 (i.e. a brace-receiving-configuration or brace-receiving configured slot 30) within the polymeric foamed material 12, the below identified hot wire cutter cuts and/or burns and/or melts back from a surface 74 (i.e. a defined surface 74) a slot 70 (preferably a generally straight thread-like slot 70 with a seared wall 32) down to a point 72 (i.e. a preconfiguration cut point 72) whereafter the below identified hot wire cutter cuts and/or burns and/or melts back the heat expandable plastic material to produce the polymeric opening 17 and/or slot 30. The polymeric opening 17 is more technically produced after a residual core 12A (see FIG. 11) is removed in any suitable manner or by any suitable means.

Certain epoxy resinous materials have also been discovered to be suitable polymeric foamed material 12. Other suitable polymeric foamed material(s) 12 for the present invention include a rigid polystyrene, polyurethene, or polyisocyanurate foam or styrofoam. The polymeric foamed material 12 of the present invention provides for prefabricated panels 10 that may be easily installed at a building site for constructing a house, an industrial building, or any other structure, generally illustrated as 40 in FIGS. 2 and 2A.

The most preferred polymeric foamed material 12 from which the panel 10 is to be constructed is expanded polystyrene beads. It is lightweight, quite strong and has excellent insulating qualities. On an outside wall 42 (see FIG. 6) of the polymeric foamed material panel 10, a sheet of outer skin facing material 46 (such as one or more asbestos cement sheet, plywood, reconstituted timer sheeting, flat steel sheet, profiled steel sheet, rigid plastic sheet or flexible metal or plastic film or various combinations of outer skins) may be mounted or secured thereto. Examples of other exterior finishes which may be applied include one or more of: metal cladding roofing material, ceramic tiling, wood, vinyl or other treatment customarily used in building construction. On an inside wall 48 (see FIG. 6 again) of the polymeric foamed material panel 10, a sheet of inner skin facing material 49 (e.g. sheet rock or the like) may be mounted or secured thereto. The sheet of inner skin facing material 49 may be any one or more suitable materials) customarily employed in finishing the inside walls, roofs, etc., in building construction.

Figure 7:
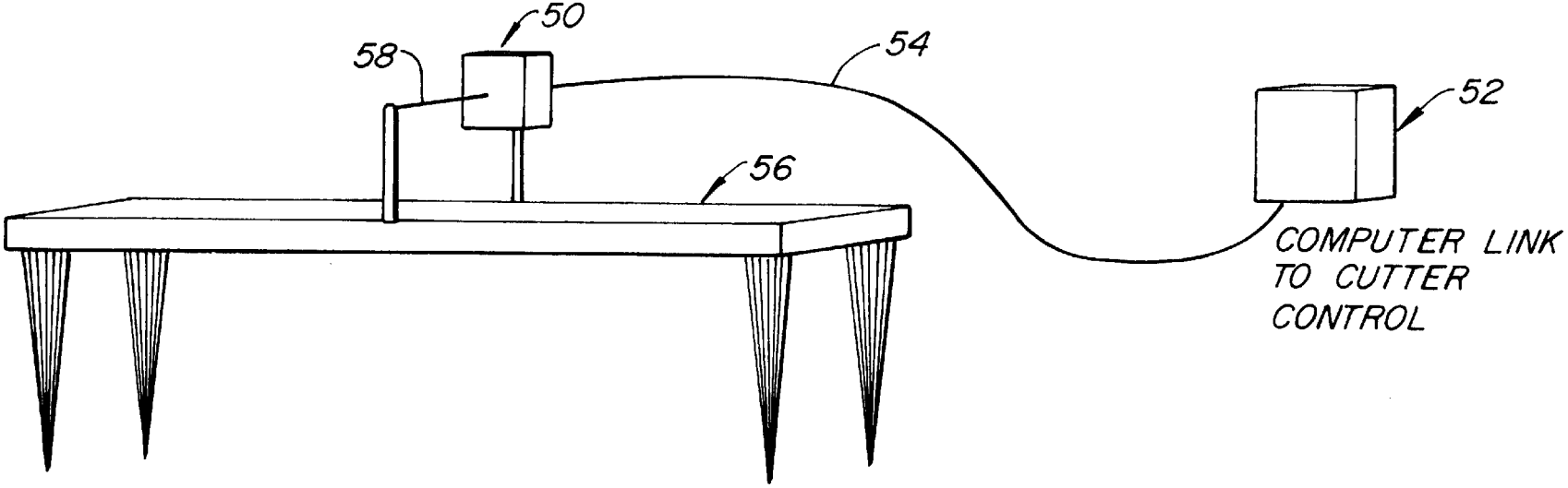
FIG. 7 is a perspective view of the hot wire cutter mounted on a table and operated by a computer.

A hot wire cutter assembly, generally illustrated as 50 (see FIG. 7), is preferably provided for cutting and searing purposes. The hot wire cutter assembly 50 is electrically engaged to a computer 52 via one or more conductors 54. The hot wire cutter assembly 50 is typically mounted on a table assembly 56 whereupon polymeric foamed material 12 is placed to be hot wire cut. The hot wire cutter assembly 50 includes a wire 58 for receiving current to be heated and to be moved for cutting and searing proposes in accordance with commands from the computer 52.

The hot wire cutter assembly 50 may be any suitable hot wire cutter assembly that is capable of cutting the desired slots (e.g. generally C-shaped slots 30 and generally vertical or straight thread-like slots 70, etc.) and openings (e.g. polymeric openings 17, etc.) in the polymeric foamed material 12. A suitable hot wire cutter assembly 50 is commercially available from Star Mfg., Inc., a division of Star Foam, Inc. of Fort Worth, Tex. The computer 52 to operate the hot wire cutter assembly 50 may also be obtained from Star Mfg., Inc. The wire 58 of the hot wire cutter assembly 50 preferably has a diameter ranging from about 0.03 inch to about 0.07 inch, more preferably from about 0.04 inch to about 0.06 inch. The wire 58 typically receives less than approximately ten (10) amps at a difference of potential of about 110 volts. At a difference in potential of about 220 volts the wire 58 would receive less than about five (5) amps. It is to be understood that the wire 58 may have any suitable diameter for practicing the present invention.

Figure 9:
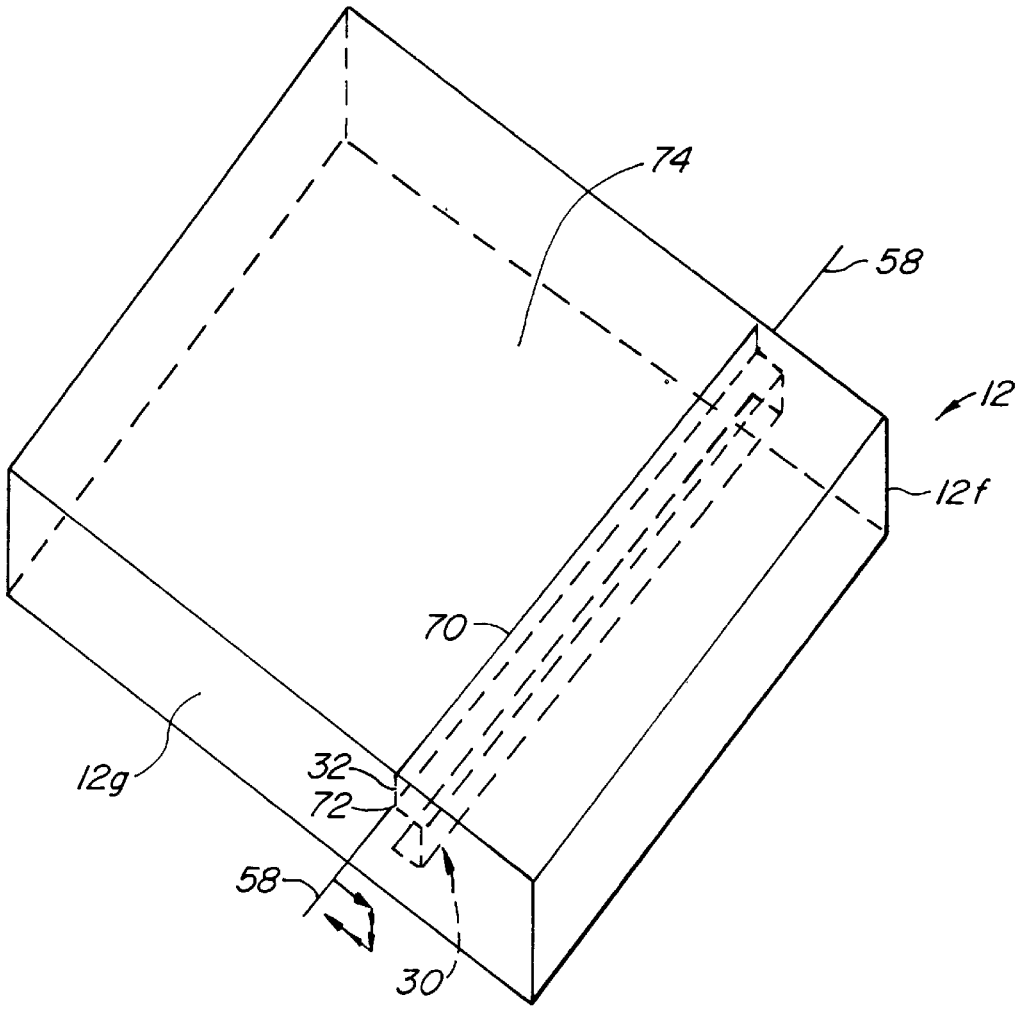
FIG. 9 is a perspective view of a hot wire cutter having cut through the polymeric foam material to a point where a subsequent general C-shaped slot is to be cut by the hot wire cutter, the C-shaped slot to be cut being represented by dotted lines.

Continuing to refer to the drawings for operation of the invention and the method for producing the panel 10, the polymeric foamed material 12 is placed upon the table assembly 56 and under the wire 58 of the hot wire cutter assembly 50. Commands are entered into the computer 52 and the wire 58 is heated to a desired temperature (e.g. from about 230° F. to about 580° F., preferably from about 250° F. to about 350° F.) and the now hot wire 58 is lowered against the surface 74 and commences to cut and/or burn and/or melt back the polymeric foamed material 12 to produce the generally straight thread-like vertical slot 70. The slot 70 is continually formed or produced until the hot wire 58 reaches point 72 (see FIG. 9) whereupon the computer 52 sends another signal to the hot wire cutter assembly 50, causing the hot wire 58 to be moved in an essentially generally C-shaped path (as represented by dotted lines in FIG. 9) to produce an essentially generally C-shaped slot 30. One or more of these slot(s) 30 may be formed in the polymeric foamed material 12 such as to terminate in the pair of opposed ends **12*f* and 12*g* of polymeric foamed material 12 (see FIGS. 19 and 10). As best shown in FIG. 9, two slot(s) 30 were produced in the polymeric foamed material 12**.

After the hot wire 58 has cut the slot(s) 30 and 70, the cutting path(s) is reversed by commands from the computer 52 such that the hot wire 58 reversely retraces its initial cutting path(s), which reverse retracing typically causes more burning and/or melt back of polymeric foamed material 12 contiguous to the slot(s) 30 and 70. In reverse retracing of its initial cutting path, the hot wire 58 is "cleaning out" the slot(s) 30 and slot(s) 70 that terminate in slot(s) 30 for further defining the slot(s) 30 and 70, especially slot 30 which is of an opening between opposed perimetrical boundaries approximating the thickness of the brace member 14 for snugly receiving the brace member 14 to essentially fully encapsulate the same. Preferably, slot(s) 30 have openings that are greater than the opening of slot(s) 70 that terminate in slot(s) 30. In reverse retracing of its initial cutting path(s), the hot wire 58 further sears and/or cartherizes the seared wall(s) 32 of the slot(s) 70 and 30 to further harden and smooth the same. After the hot wire 58 has reversely retraced its initial cutting path(s), the hot wire 58 exits out of slot 70 that terminates in slot 30 and is subsequently elevated above the surface 74.

Figure 10:
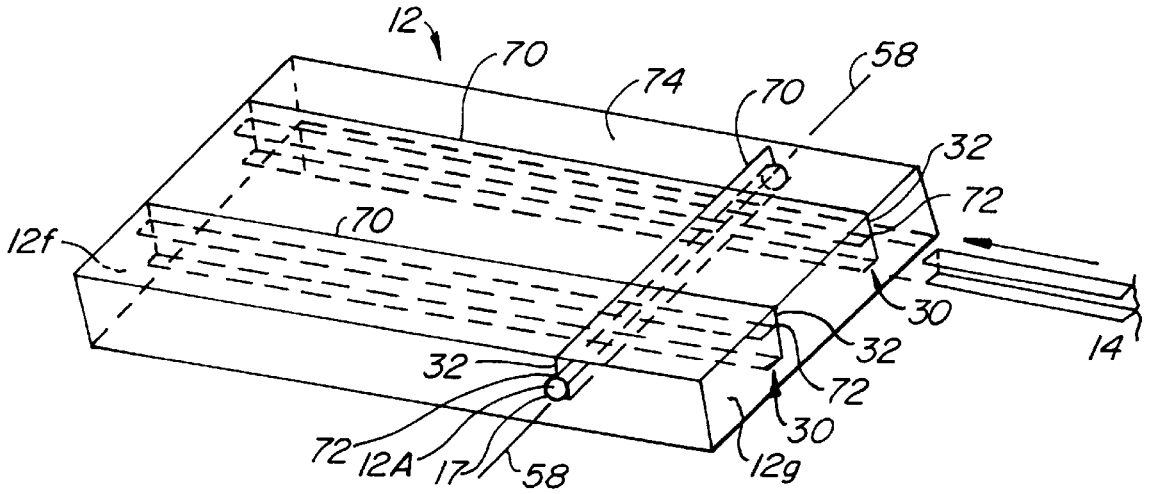
FIG. 10 is a perspective view of the polymeric foamed material after a pair of C-shaped slots have been cut with the hot wire cutter and after the polymeric foam material has been rotated, with a hot wire cutter having cut a general cylindrical opening in the polymeric foam material transverse to the C-shaped slots, leaving a residual core material in the transverse opening; and further illustrating a metallic U-shaped stud in proximity to one of the C-shaped or slots for being slid into the same.
Figure 11:
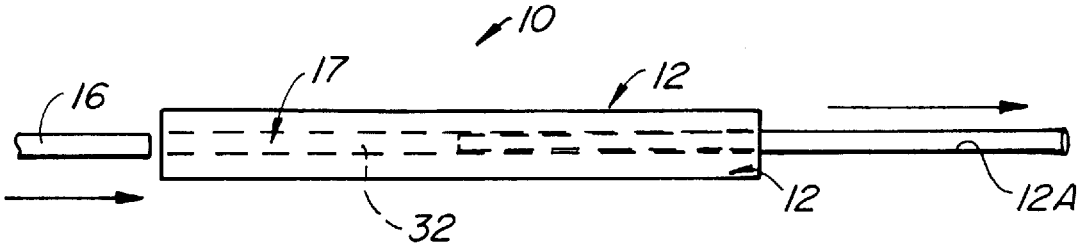
FIG. 11 is an end elevational view of the residual core material being removed from the cylindrical opening in the polymeric foam material and with a conduit aligned with the cylindrical opening in order to be slid subsequently therein.

After forming the desired number of slot(s) 30, the polymeric foamed material 12 is subsequently preferably rotated on top of the table assembly 56 in order to posture the polymeric foamed material 12 for formation of the polymeric opening(s) 17. This obviously is an optional step since there are times that the polymeric foamed material panel 10 is to be produced without any polymeric opening(s) 17. The amount of rotation of the polymeric foamed material 12 for forming polymeric opening(s) 17 would be any suitable amount to accomplish the desired cutting results. Preferably, for a square or rectangular shaped polymeric foamed material 12 as shown in FIGS. 9 and 10, the rotation would be approximately 90° such that the polymeric opening 17 to be formed would be generally normal to the slot(s) 30.

In forming the polymeric opening 17, the hot wire 58 is lowered by the hot wire cutter assembly 50 against the surface 74 and another slot 70 is commenced to be cut by the hot wire 58. The slot 70 is continually cut until a point 72 (i.e. a preconfiguration cut point 72) is again reached whereupon the computer signals the hot wire cutter assembly 50 to move the hot wire 58 in a circular fashion or manner to cut and/or burn and/or melt back polymeric foamed material 12 such that when the core material 12A is removed, the polymeric opening 17 is produced with slot 70 terminating in polymeric opening 17. As previously indicated, removal of the core material 12A may be by any suitable means including manual removal of it.

As was seen in the production of slot(s) 30 and 70, after the hot wire 58 has cut polymeric opening 17 (i.e. cylindrical polymeric opening 17) and slot(s) 70 that terminate in polymeric opening(s) 17, the cutting path(s) (e.g. a cylindrical cutting path) is reversed by commands from the computer 52 such that the hot wire 58 reversely retraces its initial cutting path(s) in the formation of polymeric opening 17. Such reverse retracing causes more burning and/or melt back of polymeric foamed material 12 contiguously or juxtaposedly exposed on the initially seared wall(s) 32 of the polymeric opening 17 and the slot(s) 70. In reverse retracing of its initial cutting path(s), the hot wire 58 is also further searing and/or cartherizing the wall (i.e. the cylindrical wall) around the core material 12A to further smooth and harden the same to facilitate the removal of the core material 12A. As was previously indicated for the formation of slot(s) 30, by reversely retracing its initial cutting path(s), the hot wire 58 is "cleaning out" the polymeric opening(s) 17 and slot(s)

70 terminating in polymeric opening(s) 17 for further defining polymeric opening(s) 17 and slot(s) 70, especially the polymeric opening(s) 17 which for cylindrical polymeric opening(s) 17 have a diameter that approximates the diameter of conduit 16 for snugly receiving conduit 16 to essentially fully encapsulate the same. Also by reverse retracing of its initial cutting path(s), the hot wire 58 further sears and/or cartherizes the seared wall(s) 32 of polymeric opening(s) 17 and the slot(s) 70 terminating in the polymeric opening (s) 17 to further harden and smooth the same. After the hot wire 58 has reversely retraced its initial cutting path(s) in the formation of polymeric opening(s) 17, the hot wire 58 exits out of the slot 70 terminating in the polymeric opening 17 and is then elevated above the surface 74.

After the core material 12A has been removed from polymeric opening 17, the brace member 14 (see FIG. 10) is aligned with the general C-shaped slot 30 (see FIG. 10) and is subsequently pushed into the cut slot 30 such that the brace member 14 would preferably extend from one extremity of the polymeric foamed material 12 to another extremity of the polymeric foamed material 12. In order words, it is preferred that the brace member 14 extends entirely through the polymeric foamed material 12 such that ends of the brace member 14 are exposed at opposed ends 12*f* and 12*g* of the polymeric foamed material 12. This enables a more optimal load-bearing function for the brace members 14. Each brace member 14 is preferably inserted into each slot 30.

Figure 4:
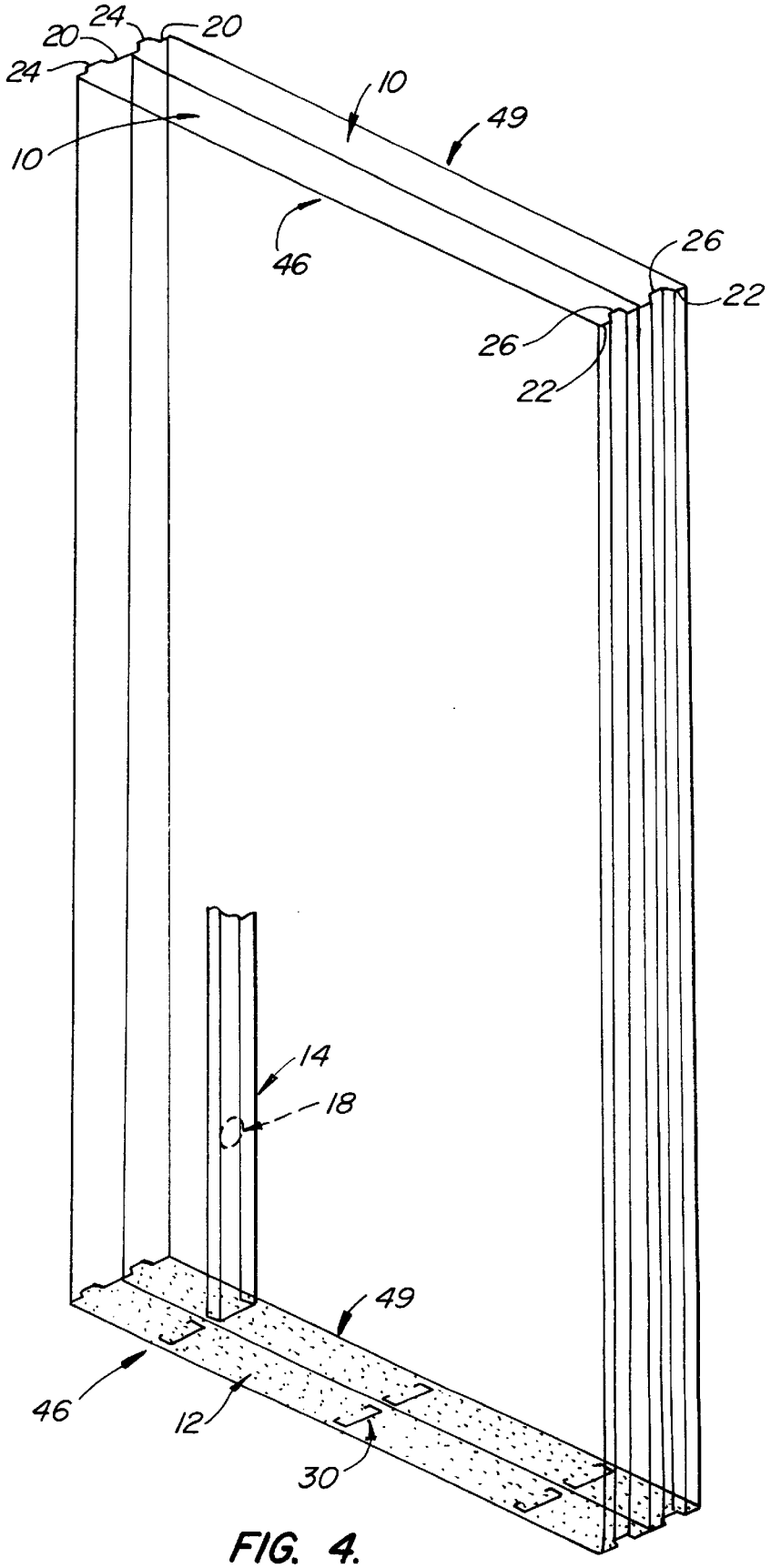
Figure 5:
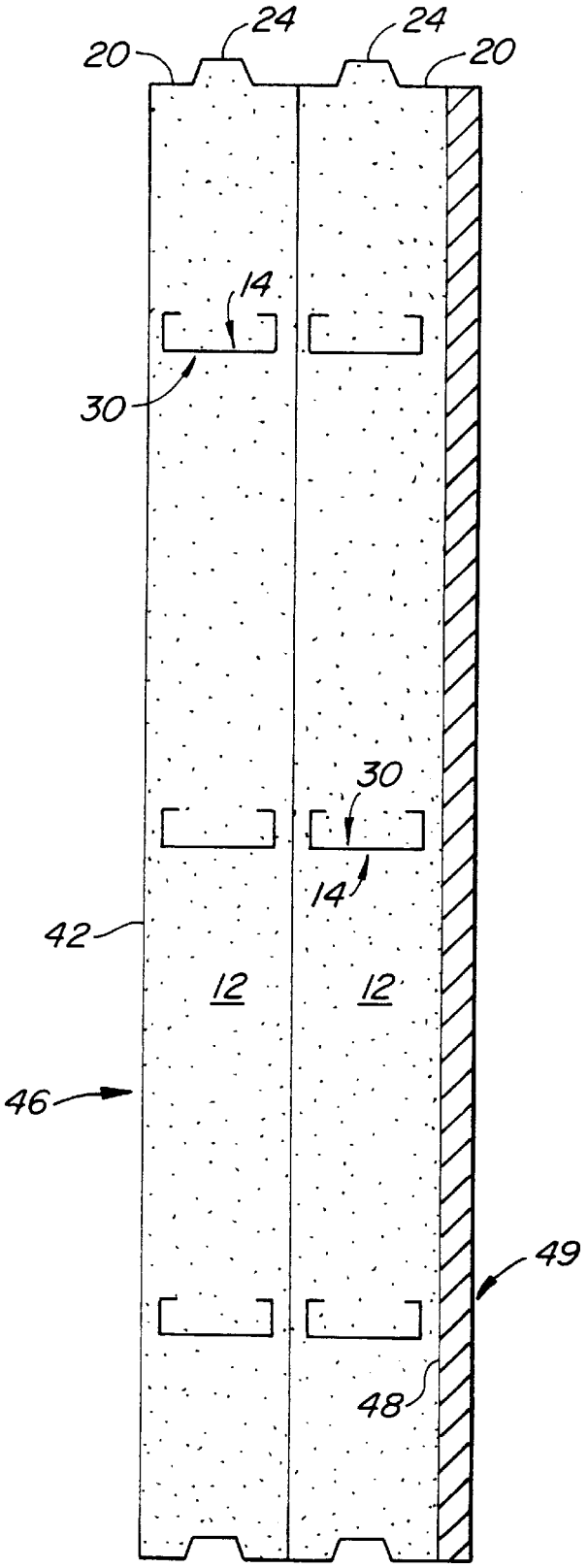

The brace members 14 may be typically provided with the opening (s) 18 which is capable of being aligned with the polymeric opening(s) 17 when and after the brace member (s) 14 are slid into the slot(s) 30 (i.e. preferably generally C-shaped slot(s) 30) in the polymeric foamed material 12. After such alignment, one or more panels 10 may be sent to a construction site such that two or more of the panel(s) 10 may be combined in any desired manner (e.g. contiguous as shown in FIGS. 4 and 5 or aligned as shown in FIG. 13) to produce a structure 40. When postured in an alignment in accordance with FIG. 13, the conduit 16 may be slid through the polymeric opening(s) 17 and through the opening(s) 18 (see FIG. 1) in the brace member(s) 14, preferably such that the conduit 16 is supported by the polymeric foamed material 12 in the two or more panels 10 and preferably such that the conduit 16 does not contact any perimeter of the opening (s) 18 in the brace member(s) 14.

The tongue 24 and the channel 26 may be cut in the opposed ends 20 and 22 of the polymeric foamed material 12 at any desired time. More specifically, the tongue 24 and the channel 26 may be cut after the generally C-shaped slot(s) 30 and polymeric opening(s) 17 have been cut in the polymeric foamed material 12, or the tongue 24 and the channel 26 may be cut before the generally C-shaped slot(s) 30 and polymeric opening(s) have been cut in the polymeric foamed material 12. After the tongue 24 and the channel 26 have been formed, any wall(s) that the hot wire 58 has contacted is or becomes seared wall(s) 32. Thus, the wall(s) of the channel 26 and the tongue 24 are seared wall(s) 32.

Thus, by the practice of the present invention there is provided a method for producing the polymeric foamed material panel 10 (e.g. a low density synthetic panel) comprising the steps of: (a) providing the polymeric foamed material 12; (b) cutting the polymeric foamed material 12 of step (a) until reaching the preconfiguration cut point 72; (c) cutting subsequently from the preconfiguration cut point 72 the brace-receiving configuration (i.e. the slot 30) in the polymeric foamed material 12; and (d) sliding the brace member into the brace-receiving configuration (or the slot 30) to produce the polymeric foamed material panel 10. The cutting in step (b) and the cutting in step (c) comprises cutting the polymeric foamed material 12 of step (a) with the hot wire cutter assembly 50 which is preferably operated by the computer 52. The brace-receiving configuration in the polymeric foamed material 12 preferably comprises the slot 30 for receiving the brace member 14. The slot 30 includes at least one seared wall 32 for facilitating the sliding of the brace member 14. The brace member 14 includes the opening 18 with an opening perimeter. The method additionally comprises forming the polymeric (foamed material) opening 17 in the polymeric foamed material 12. The polymeric foamed material opening 17 has a polymeric foamed material opening perimeter. The sliding in step (d) comprises sliding the brace member 14 into the brace-receiving configuration until the opening 18 of the brace member 14 is generally aligned with the polymeric (foamed material) opening 17. The opening perimeter of the opening 18 in the brace member 14 has a dimension that is greater than a dimension of the polymeric foamed material opening perimeter of the polymeric (foamed material) opening 17 in the polymeric foamed material 12. By the practice of the present invention there is further provided a method for forming a structure 40 comprising the steps of: (a) providing a first polymeric foamed material 12 having a first defined edge 20 (i.e. end 20); (b) cutting a first brace-receiving-configured slot 30 in the first polymeric foamed material 12; (c) cutting the first defined edge 20 of the first polymeric foamed material 12 to form the tongue 24 on the first defined edge 20; (d) sliding a first brace member 14 into the first brace-receiving-configured slot 30; (e) providing a second polymeric foamed material 12 having a second defined edge 22 (i.e. end 22); (f) cutting a second brace-receiving-configured slot 30 in the second polymeric foamed material 12; (g) cutting the second defined edge 22 of the second polymeric foamed material 12 to form the channel 26 in the second defined edge 22; (h) sliding the second brace member 14 into the second brace-receiving-configured slot 30; and (i) sliding the tongue 24 on the first defined edge 20 of the first polymeric foamed material 12 into the channel 26 in the second defined edge 22 of the second polymeric foamed material 12 to form the structure 40.

Thus further, by the practice of the present invention there is also provided a polymeric foamed material panel 10 comprising a panel 10 consisting of the polymeric foamed material 12; a brace-receiving-configured slot (i.e. slot 30 preferably) disposed in the polymeric foamed material 12 of the panel 10 and a brace member 14 disposed in the brace-receiving-configured slot 30 in the polymeric foamed material 12 of the panel 10. The preferred brace-receiving-configured slot 30 includes at least one seared wall 32; typically all walls of the slot 30 are seared. The polymeric foamed material panel 10 additionally comprises a generally straight thread-like slot 70 extending from a defined surface 74 of the polymeric foamed material 12 to the brace-receiving-configured slot 30; and a second generally straight thread-like slot 70 extending from the defined surface 74 of the polymeric foamed material 12 to a generally cylindrical polymeric opening 17 in the polymeric foamed material 12. All walls of the polymeric opening 17 are typically seared.

Thus also further, by the practice of this invention there is also provided a polymeric foamed material panel 10 which may be processed into any suitable blocks, for example, 4 feet by 4 feet by 24 feet. These blocks of polymeric foamed material 12 have been hot wired cut into an associated desired thickness as needed by the laminator/panel manufacturer. The polymeric foamed material panes(s) 10 of the present invention preferably encapsulate metal studs or braces 14 (as well as rafters if desired) in order to eliminate the need for plywood or OSB skins and the adhesives currently required in panel production. The metal studs 14 and rafters supply the structural engineering strength requirements.

Figure 2:
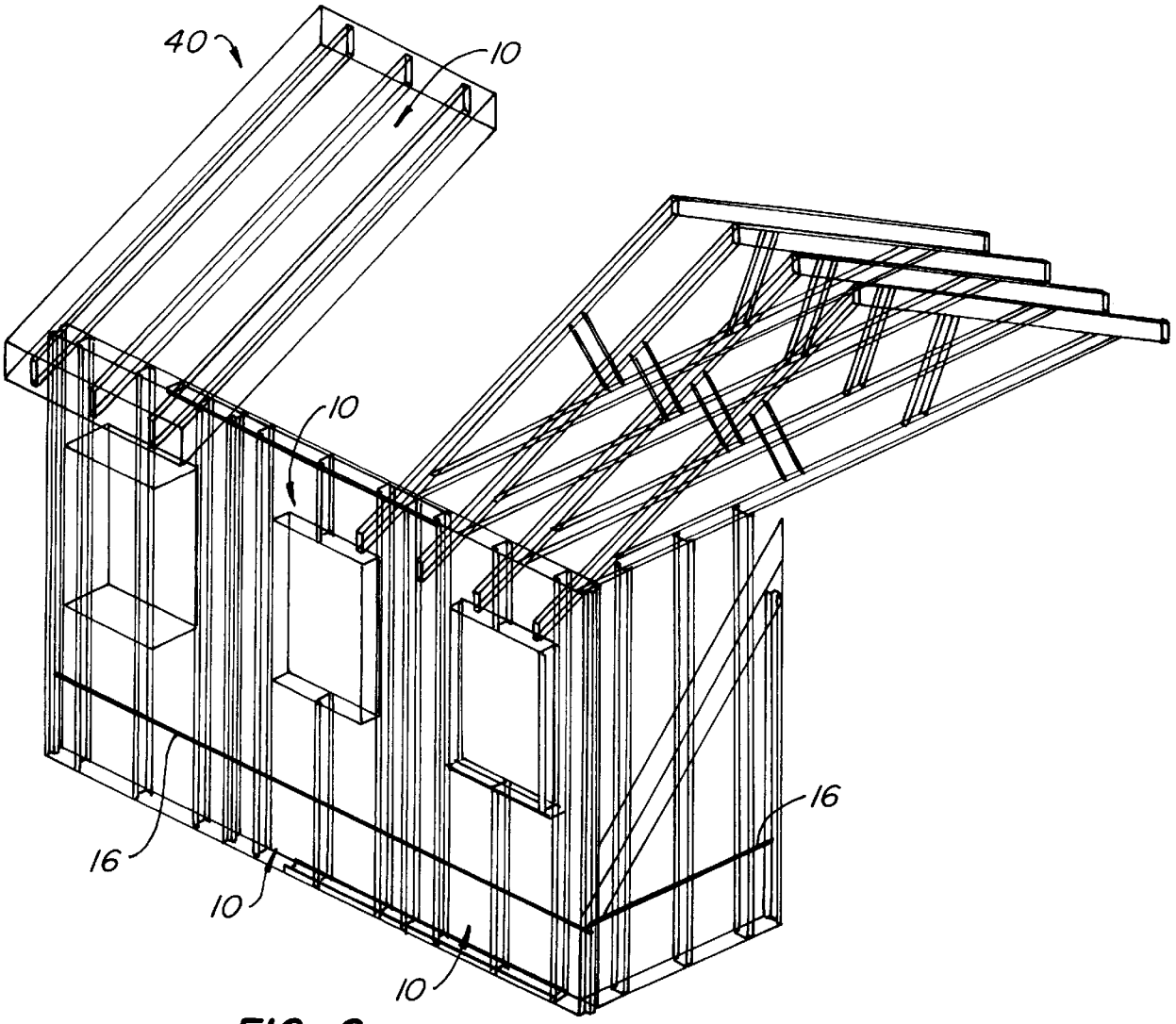
FIG. 2 is a partial perspective view of a structure consisting of standard trusses and polymeric foamed material panels forming walls and roofs.
Figure 2A:
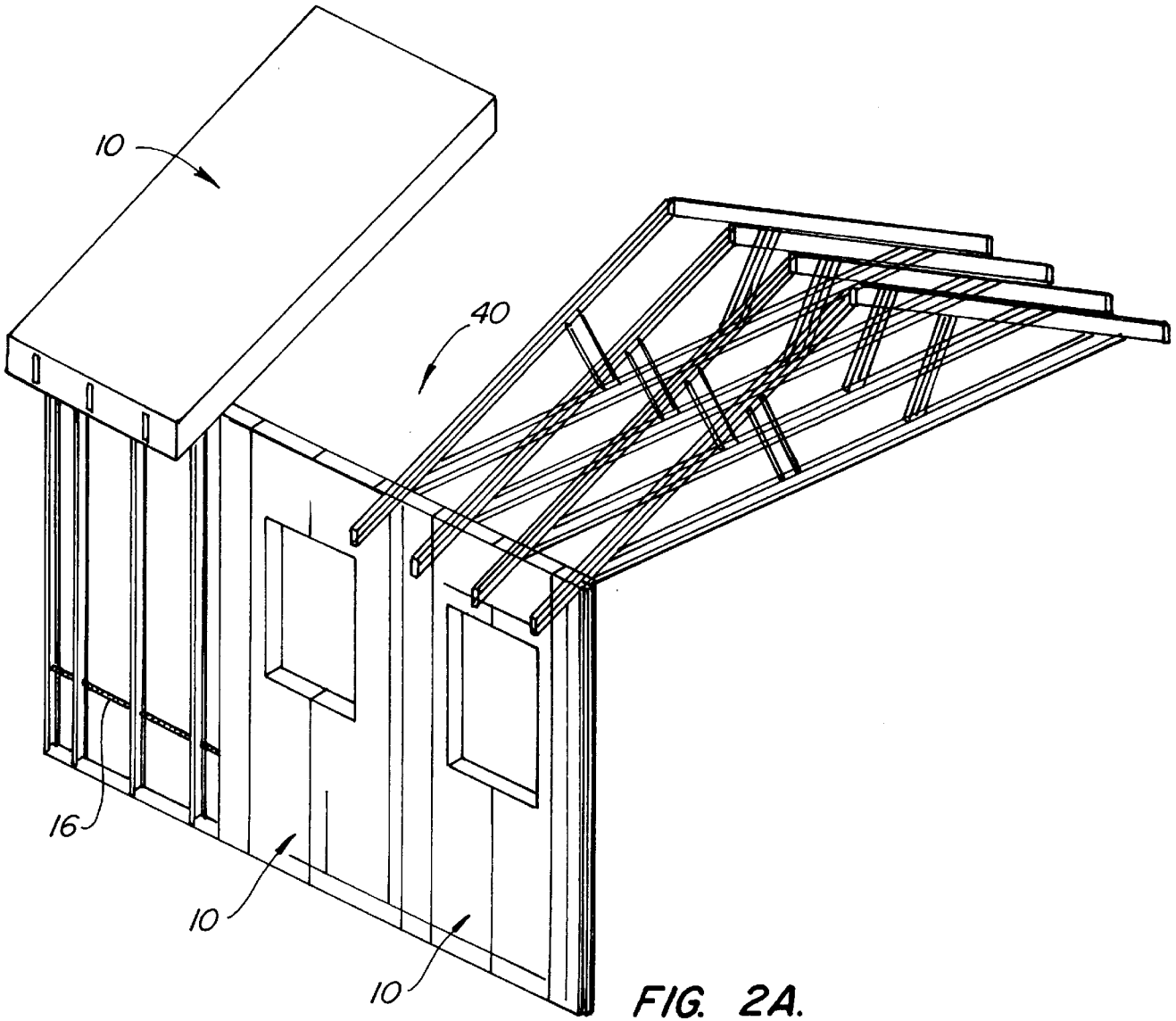
FIG. 2A is another partial perspective view of a structure similar to the partial perspective view in FIG. 2 wherein the structure includes standard trusses and polymeric foamed material panels forming walls and roofs.
Figure 3:
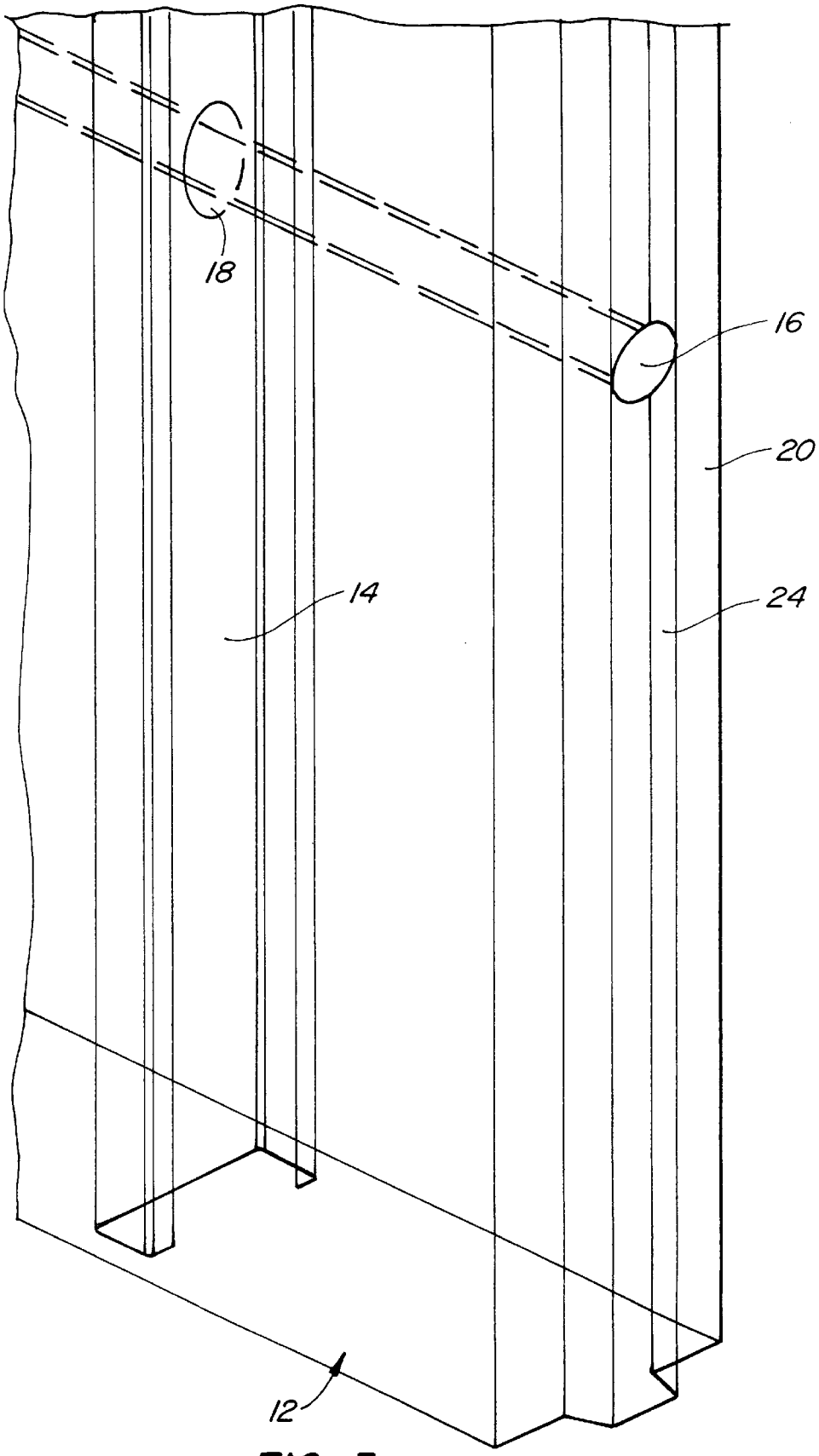
FIG. 3 is a partial perspective view of a polymeric foamed material panel including a brace member having an opening with a conduit supported by the polymeric foamed material and passing through the opening of the brace member without contacting any of the circumference or perimeter of the opening of the brace member.

The polymeric foamed material panel 10 becomes a pre-engineered "system" for building homes, apartments and commercial buildings or structures, as represented by structure(s) 40 in FIGS. 2 and 2A. The polymeric foamed material panel(s) 10 of the present invention is an improvement over the prior art in that they become both the structure and the substrate for the interior and exterior finishes. The polymeric foamed material panel(s) 10 and the method of the present invention are also an improvement over the prior art in that they provide a market ready product at a significantly lower cost by eliminating secondary processing steps. The polymeric foamed material panel(s) 10 may be used in tandem with traditional Stress Skin and Structural Panels when attachment of a specific product (e.g. asphalt shingles, etc.) to the panel(s) 10 requires a solid wood substrate.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. A method for producing a polymeric foamed material panel comprising the steps of:

(a) providing a polymeric foamed material having a defined planar surface and a pair of opposed ends;

(b) cutting the polymeric foamed material of step (a) in a generally perpendicular direction from the defined planar surface until reaching a preconfiguration cut point;

(c) cutting subsequently from said preconfiguration cut point a brace-receiving configuration in said polymeric foamed material such that said brace-receiving configuration terminates in said opposed ends; and (d) sliding a brace member into said brace-receiving configuration to produce a polymeric foamed material panel.

2. The method of claim 1 wherein said cutting in step (b) and said cutting in step (c) comprises cutting the polymeric foamed material of step (a) with a hot wire cutter.

3. The method of claim 2 additionally comprising computer operating said hot wire cutter.

4. The method of claim 1 wherein said brace-receiving configuration in said polymeric foamed material comprises a slot with a wall for receiving the brace member.

5. The method of claim 4 wherein said wall of said slot includes a seared wall for facilitating the sliding of said brace member.

6. The method of claim 1 wherein said brace member includes an opening with an opening perimeter.

7. The method of claim 6 additionally comprising forming a polymeric foamed material opening in said polymeric foamed material, said polymeric foamed material opening having a polymeric foamed material opening perimeter.

8. The method of claim 7 wherein said sliding in step (d) comprises sliding the brace member into said brace-receiving configuration until said opening of said brace member is generally aligned with said polymeric foamed material opening.

9. The method of claim 8 wherein said opening perimeter of said opening in said brace member has a dimension that is greater than a dimension of said polymeric foamed material opening perimeter of said polymeric foamed material opening in said polymeric foamed material.

10. The method of claim 9 additionally comprising passing a conduit through said polymeric foamed material opening of said polymeric foamed material and through said opening of said brace member.

11. The method of claim 9 additionally comprising passing a conduit through said polymeric foamed material opening of said polymeric foamed material and through said opening of said brace member such that said conduit is essentially supported by said polymeric foamed material and essentially does not contact any of the opening perimeter of said opening in said brace member.

12. The method of claim 10 wherein said polymeric foamed material comprises expanded polystyrene (ESP).

13. The method of claim 1 wherein said cutting in step (b) comprises cutting a generally straight thread-like slot from said defined planar surface of said polymeric foamed material to said preconfiguration cut point.

14. The method of claim 13 wherein said brace-receiving configuration is essentially a generally C-shaped slot.

15. The method of claim 14 wherein said cutting in step (b) and said cutting in step (c) comprises cutting the polymeric foamed material of step (a) with a hot wire cutter.

16. The method of claim 15 wherein said hot wire cutter being at a temperature such as to sear at least one wall of the C-shaped slot to smooth and harden said wall of the C-shaped slot for facilitating said sliding in step (d) of said brace member.

17. The method of claim 16 wherein said polymeric foamed material comprises expanded polystyrene (EPS).

18. The method of claim 1 wherein said polymeric foamed material comprises expanded polystyrene (ESP).

19. A polymeric foam material panel produced in accordance with the method of claim 1.

20. A method for forming a structure comprising the steps of:

(a) providing a first polymeric foamed material having a first defined edge;

(b) cutting the first polymeric foamed material until reaching a first preconfiguration cut point and cutting subsequently from said first preconfiguration cut point a first brace-receiving-configured slot in said first polymeric foamed material such that said first brace-receiving-configured slot terminates in said opposed first ends;

(c) cutting said first defined edge of said first polymeric foamed material to form a tongue on said first defined edge;

(d) sliding a first brace member into said first brace-receiving-configured slot;

(e) providing a second polymeric foamed material having a second defined edge;

(f) cutting the second polymeric foamed material until reaching a second preconfiguration cut point and cutting subsequently from said second preconfiguration cut point a second brace-receiving-configured slot in said second polymeric foamed material such that said second brace-receiving-configured slot terminates in said opposed second ends;

(g) cutting said second defined edge of said second polymeric foamed material to form a channel in said second defined edge;

(h) sliding a second brace member into said second brace-receiving-configured slot; and (i) sliding said tongue on said first defined edge of said first polymeric foamed material into said channel in second defined edge of said second polymeric foamed material to form a structure.

21. The method of claim 20 wherein said cutting in steps (b), (c), (f) and (g) comprises cutting with a hot wire cutter.

22. The method of claim 21 additionally comprising computer operating said hot wire cutter.

23. The method of claim 20 wherein said first brace-receiving-configured slot in said first polymeric foamed material comprises a first slot with a first wall for receiving the first brace member and said second brace-receiving-configured slot in said second polymeric foamed material comprises a second slot with a second wall for receiving the second brace member.

24. The method of claim 23 wherein said first wall of said first slot includes a first seared wall for facilitating the sliding of the first brace member and said second wall of said second slot includes a second seared wall for facilitating the sliding of the second brace member.

25. The method of claim 24 wherein said first brace member includes a first opening with a first opening perimeter and said second brace member includes a second opening with a second opening perimeter.

26. The method of claim 25 additionally comprising forming a first polymeric foamed material opening in said first polymeric foamed material and forming a second polymeric foamed material opening in said second polymeric foamed material, said first polymeric foamed material opening includes a first polymeric foamed material opening perimeter and said second polymeric foamed material opening includes a second polymeric foamed material opening perimeter.

27. The method of claim 26 wherein said sliding step (d) comprises sliding the first brace member into the said first brace-receiving-configured slot until said first opening of said first brace member is generally aligned with said first polymeric foamed material opening; and wherein said sliding step (h) comprises sliding the second brace member into said second brace-receiving-configured slot until said second opening of said second brace member is generally aligned with said second polymeric foamed material opening.

28. The method of claim 27 wherein said first opening perimeter of said first opening in said first brace member has a first dimension that is greater than a first dimension of said first polymeric foamed material opening perimeter of said first polymeric foamed material opening in said first polymeric foamed material; and said second opening perimeter of said second opening in said second brace member has a second dimension that is greater than a second dimension of said second polymeric foamed material opening perimeter of said second polymeric foamed material opening in said second polymeric foamed material.

29. The method of claim 28 additionally comprising passing a conduit through said first polymeric foamed material opening in said first polymeric foamed material and through said first opening of said first brace member and further passing said conduit through said second polymeric foamed material opening in said second polymeric foamed material and through said second opening of said second brace member.

30. The method of claim 28 additionally comprising passing a conduit through said first polymeric foamed material opening of said first polymeric foamed material and through said first opening of said first brace member and further passing said conduit through said second polymeric foamed material opening of said second polymeric foamed material and through said second opening of said second brace member such that said conduit is essentially supported by said first polymeric foamed material and by said second polymeric foamed material and essentially does not contact any of the first opening perimeter of said first opening in said first brace member and any of said second opening perimeter of said second brace member.

31. The method of claim 29 wherein said first polymeric foamed material and said second polymeric foamed material comprises expanded polystyrene (EPS).

32. The method of claim 20 wherein said first brace-receiving-configured slot is essentially a first generally C-shaped slot and said second brace-receiving-configured slot is essentially a second generally C-shaped slot.

33. The method of claim 32 wherein said cutting in step (b), step (c), step (f), and step (g) comprises cutting with a hot wire cutter.

34. The method of claim 33 wherein said hot wire cutter being at a temperature such as to sear at least one wall of said first C-shaped slot and to sear at least one wall of said second C-shaped slot to smooth and harden said wall of said first C-shaped slot and to smooth and harden said wall of said second C-shaped slot for facilitating said sliding in step (d) of said first brace member and for facilitating said sliding in step (h) of said second brace member.

35. The method of claim 34 wherein said first polymeric foamed material and said second polymeric foamed material comprises expanded polystyrene (EPS).

36. The method of claim 20 wherein said first polymeric foamed material and said second polymeric foamed material comprises expanded polystyrene (EPS).

37. The method of claim 20 wherein said Seep (b) cutting of the first polymeric foamed material until reaching said first preconfiguration cut point comprises contacting said first defined planar surface of said first polymeric foamed material with a first hot wire cutter and subsequently cutting with said first hot wire cutter a first generally straight thread-like slot in said first polymeric foamed material up to said first preconfiguration cut point; and wherein said step (f) cutting of the second polymeric foamed material until reaching said second preconfiguration cut point comprises contacting said second defined planar surface of said second polymeric foamed material with a second hot wire cutter and subsequently cutting with said second hot wire cutter a second generally straight thread-like slot in said second polymeric foamed material up to said second preconfiguration cut point.

38. A structure produced in accordance with the method of claim 37.

39. A method for producing a polymeric foamed material panel comprising the steps of:

(a) providing a polymeric foamed material in a generally stationary position, said polymeric foamed material having a defined planar surface and a pair of opposed ends;

(b) cutting the generally stationary polymeric foamed material of step (a) in a generally perpendicular direction from the defined planar surface until reaching a preconfiguration cut point;

(c) cutting subsequently from said preconfiguration cut point a brace-receiving configuration in said generally stationary polymeric foamed material such that said brace-receiving configuration terminates in said opposed ends; and (d) sliding a brace member into said brace-receiving configuration to produce a polymeric foamed material panel.

40. The method of claim 39 wherein said cutting in step (b) and said cutting in step (c) comprises cutting the polymeric foamed material of step (a) with a hot wire cutter.

41. The method of claim 40 additionally comprising computer operating said hot wire cutter.

42. The method of claim 40 wherein said brace-receiving configuration in said polymeric foamed material comprises a slot with a wall for receiving the brace member.

43. The method of claim 42 wherein said wall of said slot includes a seared wall for facilitating the sliding of said brace member.

44. The method of claim 42 wherein said slot is a non-linear slot.

45. The method of claim 40 wherein said brace member includes brace sides which are surrounded by said polymeric foamed material.

46. The method of claim 40 wherein said brace-receiving configuration is a non-linear configuration.

47. The method of claim 39 wherein said brace member includes an opening with an opening perimeter.

48. The method of claim 39 wherein said brace member includes brace sides which are surrounded by said polymeric foamed material.

49. The method of claim 39 wherein said brace-receiving configuration is a non-linear configuration.

50. The method of claim 39 wherein said cutting step (b) comprises contacting a generally planar surface of said generally stationary polymeric foamed material with a hot wire cutter, and subsequently cutting with said hot wire cutter from said generally planar surface a slot in said generally stationary polymeric foamed material until reaching said preconfiguration cut point.

51. The method of claim 50 additionally comprising removing, prior to said sliding step (d), said hot wire cutter from said generally stationary polymeric foamed material through said slot.

52. The method of claim 51 wherein said slot is a generally straight thread-like slot.

53. A method for producing a polymeric foamed material panel comprising the steps of:

(a) providing a polymeric foamed material with a defined planar side surface and a pair of opposed ends;

(b) cutting with a cutter in a generally perpendicular direction from said defined planar side surface a path in the polymeric foamed material of step (a) such that said path terminates in said opposed ends;

(c) retracing said path of step (b) with said cutter to produce a brace-receiving configuration in said polymeric foamed material such that said brace-receiving configuration terminates in said opposed ends; and (d) sliding a brace member into said brace-receiving configuration to produce a polymeric foamed material panel.

54. The method of claim 53 wherein said cutter in step (b) comprises a hot wire cutter.

55. The method of claim 54 additionally comprising computer operating said hot wire cutter.

56. The method of claim 54 wherein said cutting step (b) comprises searing with said hot wire cutter a seared path in said polymeric foamed material of step (a); and said retracing step (c) comprises researing said seared path with said hot wire cutter.

57. The method of claim 56 wherein said seared path is a non-linear seared path.

58. The method of claim 54 wherein said brace-receiving configuration is a non-linear configuration.

59. The method of claim 53 wherein said brace-receiving configuration in said polymeric foamed material comprises a slot with a wall for receiving the brace member.

60. The method of claim 59 wherein said wall of said slot includes a seared wall for facilitating the sliding of said brace member.

61. The method of claim 59 wherein said slot is a non-linear slot.

62. The method of claim 53 wherein said brace member includes an opening with an opening perimeter.

63. The method of claim 53 wherein said brace-receiving configuration is a non-linear configuration.

64. A method for producing a polymeric foamed material panel comprising the steps of:

(a) providing a polymeric foamed material having a defined planar side surface and a pair of opposed ends;

(b) contacting the defined planar side surface with a cutter;

(c) cutting with said cutter said polymeric foamed material in a generally perpendicular direction from said defined planar side surface thereof until reaching a preconfiguration cut point within said polymeric foamed material;

(d) cutting with said cutter from said preconfiguration cut point of step (c) a slot in the polymeric foamed material of step (c) such that said slot terminates in said opposed ends;

(e) cleaning said slot of step (d) with said cutter to produce a brace-receiving configuration in said polymeric foamed material such that said brace-receiving configuration terminates in said opposed ends; and (f) sliding a brace member into said brace-receiving configuration to produce a polymeric foamed material panel.

65. The method of claim 64 wherein said cutter in step (b) comprises a hot wire cutter for searing a seared path in the said polymeric foamed material of step (a) to produce said slot of step (d).

66. The method of claim 65 additionally comprising computer operating said hot wire cutter.

67. The method of claim 65 wherein said cleaning of said slot with said hot wire cutter comprises researing said seared path.

68. The method of claim 67 wherein said seared path is a non-linear seared path.

69. The method of claim 65 wherein said brace-receiving configuration is a non-linear configuration.

70. The method of claim 64 wherein said brace-receiving configuration in said polymeric foamed material comprises a slot with a wall for receiving the brace member.

71. The method of claim 70 wherein said wall of said slot includes a seared wall for facilitating the sliding of said brace member.

72. The method of claim 64 wherein said brace member includes an opening with an opening perimeter.

73. The method of claim 64 wherein said cleaning of said slot with said cutter comprises reversely recutting said slot.

74. The method of claim 73 wherein said slot is a non-linear slot.

75. The method of claim 64 wherein said brace-receiving configuration is a non-linear configuration.

76. The method of claim 64 additionally comprising passing said cutter through said preconfiguration cut point and subsequently removing, prior to said sliding step (f), said hot wire cutter from said generally stationary polymeric foamed material.

77. The method of claim 76 wherein said cutter is a hot wire cutter.

78. The method of claim 77 additionally comprising computer operating said hot wire cutter.

79. A polymeric foamed material panel produced in accordance with the method of claim 78.

80. A polymeric foamed material panel produced in accordance with the method of claim 64.

* * * * *